US007973720B2

(12) United States Patent
Sorvala

(10) Patent No.: US 7,973,720 B2
(45) Date of Patent: Jul. 5, 2011

(54) CHIP ANTENNA APPARATUS AND METHODS

(75) Inventor: Juha Sorvala, Oulu (FI)

(73) Assignee: LKP Pulse Finland OY, Kempele (FI)

( * ) Notice: Subject to any disclaimer, the term of this patent is extended or adjusted under 35 U.S.C. 154(b) by 0 days.

(21) Appl. No.: 12/661,394

(22) Filed: Mar. 15, 2010

(65) Prior Publication Data

US 2010/0176998 A1 Jul. 15, 2010

Related U.S. Application Data

(63) Continuation of application No. 11/648,431, filed on Dec. 28, 2006, now Pat. No. 7,679,565, which is a continuation of application No. PCT/FI2005/050089, filed on Mar. 16, 2005.

(30) Foreign Application Priority Data

Jun. 28, 2004 (FI) ..... 20040892

(51) Int. Cl.
*H01Q 1/38* (2006.01)

(52) U.S. Cl. ..... 343/700 MS; 343/846

(58) Field of Classification Search ..... 343/700, 343/702, 829, 846
See application file for complete search history.

(56) References Cited

U.S. PATENT DOCUMENTS

| | | | | |
|---|---|---|---|---|
| 4,069,483 | A | 1/1978 | Kaloi | |
| 4,401,988 | A * | 8/1983 | Kaloi | 343/700 MS |
| 5,001,492 | A * | 3/1991 | Shapiro et al. | 343/700 MS |
| 5,157,363 | A | 10/1992 | Puurunen | |
| 5,281,326 | A | 1/1994 | Galla | |
| 5,298,873 | A | 3/1994 | Ala-Kojola | |
| 5,349,700 | A | 9/1994 | Parker | |

(Continued)

FOREIGN PATENT DOCUMENTS

EP 0 376 643 A2 4/1990

(Continued)

OTHER PUBLICATIONS

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., pp. 15-24, waelsall@rockwellcollins.com and blhauck@rockwellcollins.com.

(Continued)

*Primary Examiner* — Tho G Phan
(74) *Attorney, Agent, or Firm* — Gazdzinski & Associates, PC

(57) ABSTRACT

A chip component with dielectric substrate and plurality of radiating antenna elements on the surface thereof. In one embodiment, two (2) substantially symmetric elements are used, each covering an opposite head and upper surface portion of the device. The surface between the elements comprises a slot. The chip is mounted on a circuit board (e.g., PCB) whose conductor pattern is part of the antenna. No ground plane is used under the chip or its sides to a certain distance. One of the antenna elements is coupled to the feed conductor on the PCB and to the ground plane, while the parasitic element is coupled only to the ground plane. The parasitic element is fed through coupling over the slot, and both elements resonate at the operating frequency. The antenna can be tuned and matched without discrete components, is substantially omni-directional, and has low substrate losses due to simple field image.

29 Claims, 5 Drawing Sheets

U.S. PATENT DOCUMENTS

| | | | | |
|---|---|---|---|---|
| RE34,898 | E | | 4/1995 | Turunen et al. |
| 5,408,206 | A | | 4/1995 | Turunen |
| 5,506,554 | A | | 4/1996 | Ala-Kojola |
| 5,521,561 | A | | 5/1996 | Yrjola |
| 5,550,519 | A | | 8/1996 | Korpela |
| 5,675,301 | A | | 10/1997 | Nappa |
| 5,764,190 | A | | 6/1998 | Murch et al. |
| 5,892,490 | A | | 4/1999 | Asakura et al. |
| 5,903,820 | A | | 5/1999 | Hagstrom |
| 5,926,139 | A | * | 7/1999 | Korisch ..... 343/702 |
| 6,133,879 | A | | 10/2000 | Grangeat et al. |
| 6,147,650 | A | | 11/2000 | Kawahata et al. |
| 6,177,908 | B1 | | 1/2001 | Kawahata |
| 6,195,049 | B1 | | 2/2001 | Kim et al. |
| 6,323,811 | B1 | | 11/2001 | Tsubaki |
| 6,384,785 | B1 | * | 5/2002 | Kamogawa et al. ... 343/700 MS |
| 6,683,573 | B2 | | 1/2004 | Park |
| 6,781,545 | B2 | | 8/2004 | Sung |
| 6,950,066 | B2 | | 9/2005 | Hendler et al. |
| 7,099,690 | B2 | | 8/2006 | Milosavljevic |
| 7,126,546 | B2 | | 10/2006 | Annamaa |
| 7,136,019 | B2 | | 11/2006 | Mikkola |
| 7,148,851 | B2 | | 12/2006 | Takaki et al. |
| 7,352,326 | B2 | | 4/2008 | Korva |
| 2002/0145569 | A1 | | 10/2002 | Onaka |
| 2002/0196192 | A1 | | 12/2002 | Nagumo et al. |
| 2003/0020659 | A1 | | 1/2003 | Kushihi |
| 2003/0092420 | A1 | | 5/2003 | Sugimoto et al. |
| 2004/0090382 | A1 | | 5/2004 | Kushihi et al. |
| 2005/0024272 | A1 | | 2/2005 | Ponce De Leon et al. |
| 2005/0078037 | A1 | | 4/2005 | Leclerc et al. |
| 2005/0243001 | A1 | | 11/2005 | Miyata et al. |
| 2006/0145924 | A1 | | 7/2006 | Chen et al. |
| 2007/0152885 | A1 | | 7/2007 | Sorvala |
| 2007/0159399 | A1 | | 7/2007 | Perunka et al. |
| 2007/0171131 | A1 | | 7/2007 | Sorvala |
| 2007/0241970 | A1 | | 10/2007 | Thornell-Pers |
| 2008/0088511 | A1 | | 4/2008 | Sorvala |
| 2008/0303729 | A1 | | 4/2008 | Milosavljevic |

FOREIGN PATENT DOCUMENTS

| | | | |
|---|---|---|---|
| EP | 0 759 646 | A1 | 2/1997 |
| EP | 0 766 341 | | 2/1997 |
| EP | 0 766 340 | | 4/1997 |
| EP | 0 831 547 | A2 | 3/1998 |
| EP | 0 942 488 | A2 | 9/1999 |
| EP | 1 003 240 | A2 | 5/2000 |
| EP | 1 052 723 | | 11/2000 |
| EP | 1 063 722 | A2 | 12/2000 |
| EP | 1 102 348 | | 5/2001 |
| EP | 1 113 524 | | 7/2001 |
| EP | 1 128 466 | A2 | 8/2001 |
| EP | 1 139 490 | | 10/2001 |
| EP | 1 146 589 | | 10/2001 |
| EP | 1 162 688 | | 12/2001 |
| EP | 1 248 316 | | 9/2002 |
| EP | 1 267 441 | | 12/2002 |
| EP | 1 294 049 | A1 | 3/2003 |
| EP | 1 151 334 | | 8/2003 |
| EP | 1 414 108 | | 4/2004 |
| EP | 1 432 072 | | 6/2004 |
| EP | 1 453 137 | | 9/2004 |
| EP | 1 482 592 | | 12/2004 |
| JP | 7249923 | | 9/1995 |
| JP | 10 028013 | | 1/1998 |
| JP | 10 209733 | | 8/1998 |
| JP | 11 004117 | | 1/1999 |
| JP | 11 355033 | | 12/1999 |
| JP | 2004112028 | | 4/2004 |
| JP | 2004363859 | | 12/2004 |
| JP | 2005005985 | | 1/2005 |
| KR | 10-2006-7027462 | | 12/2002 |
| WO | WO 00/36700 | | 6/2000 |
| WO | WO 01/33665 | | 5/2001 |
| WO | WO 2004/070872 | | 8/2004 |
| WO | WO 2004/100313 | | 11/2004 |
| WO | WO 2004/112189 | A | 12/2004 |
| WO | WO 2005/011055 | | 2/2005 |
| WO | WO 2005/018045 | | 2/2005 |
| WO | WO 2005/038981 | A1 | 4/2005 |
| WO | WO 2005/055364 | | 6/2005 |

OTHER PUBLICATIONS

O. Kivekäs, et al.; "Frequency-tunable internal antenna for mobile phones", Proceedings of 12èmes Journées Intemationales de Nice sur les Antennes, 12$^{th}$ Int'l Symposium on Antennas (JINA 2002), vol. 2, 2002, Nice, France, s_53-56, tiivistelmä .

* cited by examiner

CHIP ANTENNA APPARATUS AND METHODS

PRIORITY AND RELATED APPLICATIONS

This is a continuation of, and claims priority to, U.S. patent application Ser. No. 11/648,431 filed Dec. 28, 2006 and entitled "Chip Antenna Apparatus and Methods" which is a continuation application of and claims priority to International PCT Application No. PCT/FI2005/050089 having an international filing date of Mar. 16, 2005, which claims priority to Finland Patent Application No. 20040892 filed Jun. 28, 2004, each of the foregoing incorporated herein by reference in its entirety.

This application is related to co-owned U.S. Pat. No. 7,589,678 issue Sep. 15, 2009 and entitled "Multi-Band Antenna With a Common Resonant Feed Structure and Methods", and co-owned U.S. Pat. No. 7,663,551 issued Feb. 16, 2010 and entitled "Multiband Antenna Apparatus and Methods", each also incorporated herein by reference in its entirety. This application is also related to co-owned and co-pending U.S. patent application Ser. No. 11/648,429 filed Dec. 28, 2006 and entitled "Antenna, Component And Methods", also incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The invention relates generally to antennas for radiating and/or receiving electromagnetic energy, and specifically in one aspect to an antenna in which the radiators are conductor coatings of a dielectric chip; the chip may be, e.g., mounted on a circuit board of a radio device, wherein the circuit board is a part of the antenna structure.

2. Description of Related Technology

In small-sized radio devices, such as mobile phones, the antenna or antennas are preferably placed inside the cover of the device, and naturally the intention is to make them as small as possible. An internal antenna has usually a planar structure so that it includes a radiating plane and a ground plane below it. There is also a variation of the monopole antenna, in which the ground plane is not below the radiating plane but farther on the side. In both cases, the size of the antenna can be reduced by manufacturing the radiating plane on the surface of a dielectric chip instead of making it air-insulated. The higher the dielectricity of the material, the smaller the physical size of an antenna element of a certain electric size. The antenna component becomes a chip to be mounted on a circuit board. However, such a reduction of the size of the antenna entails the increase of losses and thus a deterioration of efficiency.

FIG. 1 shows a chip antenna known from the publications EP 1 162 688 and U.S. Pat. No. 6,323,811, in which antenna there are two radiating elements side by side on the upper surface of the dielectric substrate 110. The first element 120 is connected by the feed conductor 141 to the feeding source, and the second element 130, which is a parasitic element, by a ground conductor 143 to the ground. The resonance frequencies of the elements can be arranged to be different in order to widen the band. The feed conductor and the ground conductor are on a lateral surface of the dielectric substrate. On the same lateral surface, there is a matching conductor 142 branching from the feed conductor 141, which matching conductor is connected to the ground at one end. The matching conductor extends so close to the ground conductor 143 of the parasitic element that there is a significant coupling between them. The parasitic element 130 is electromagnetically fed through this coupling. The feed conductor, the matching conductor and the ground conductor of the parasitic element together form a feed circuit; the optimum matching and gain for the antenna can then be found by shaping the strip conductors of the feed circuit. Between the radiating elements, there is a slot 150 running diagonally across the upper surface of the substrate, and at the open ends of the elements, i.e. at the opposite ends as viewed from the feeding side, there are extensions reaching to the lateral surface of the substrate. By means of such design, as well by the structure of the feed circuit, it is aimed to arrange the currents of the elements orthogonally so that the resonances of the elements would not weaken each other.

A drawback of the above described antenna structure is that in spite of the ostensible optimization of the feed circuit, waveforms that increase the losses and are effectively useless with regard to the radiation produced by the device are created in the dielectric substrate. The efficiency of the antenna is thus comparatively poor and not satisfactory. In addition, there is significant room for improvement if a relatively even radiation pattern, or omnidirectional radiation, is required.

SUMMARY OF THE INVENTION

The present invention addresses the foregoing needs by disclosing antenna component apparatus and methods.

In a first aspect of the invention, an antenna apparatus is disclosed. In one embodiment, the antenna apparatus comprises: a dielectric substrate comprising a plurality of surfaces, a ground plane, a first antenna element, a second antenna element, and an electromagnetic coupling element disposed substantially between the first element and the second element. In one variant, the first antenna element is configured to be galvanically coupled to a feed structure at a third location, and the second antenna element is configured to be electromagnetically coupled to the feed structure through the electromagnetic coupling element so as to form a resonant structure between the first antenna element, the second antenna element, the dielectric substrate, and the ground plane.

In another variant, the first element is disposed at least partially on a first surface of the dielectric substrate and at least partially on a second surface of the dielectric substrate, and the first antenna element is configured to be coupled to the ground plane at a first location.

In another variant, the second element is disposed at least partially on a third surface of the dielectric substrate, the third surface and the first surface being disposed substantially at opposite ends of the substrate, and at least partially on the second surface. The second antenna element is configured to be coupled to the ground plane at a second location.

In yet another variant, the ground plane is disposed a first predetermined distance away from the dielectric substrate along at least a portion of a fourth surface and along at least a portion of a fifth surface of the dielectric substrate, the fifth surface substantially opposing the fourth surface. The first and the third locations are disposed proximate a first and a second corner of the dielectric substrate, respectively, the first and the second corner arranged along a first edge of the dielectric substrate. The second location is disposed proximate a third corner of the dielectric substrate, the third corner arranged along a second edge of the dielectric substrate, the second edge substantially opposing the first edge.

In still another variant, the ground plane is further disposed: (i) a second predetermined distance away from the dielectric substrate along at least a portion of the first surface, and (ii) a third predetermined distance away from the dielectric substrate along at least a portion of the third surface.

In another variant, the second antenna element is further configured to be coupled to the ground plane at a fourth location, the fourth location positioned distally relative to the electromagnetic coupling element, e.g., the first and the third locations are disposed proximate a first and a second corner of the dielectric substrate, respectively, the second and the fourth locations are disposed proximate a third and a fourth corner of the dielectric substrate, respectively, the first and the second corner arranged along a first edge of the dielectric substrate, and the third and the fourth corner are arranged along a second edge of the dielectric substrate, the second edge opposing the first edge.

In another embodiment, the antenna apparatus comprises: a dielectric substrate comprising a plurality of surfaces, a ground plane, a first antenna element disposed at least partially on a first surface of the dielectric substrate and at least partially on a second surface of the dielectric substrate, the first antenna element configured to be coupled to the ground plane at a first location, a second antenna element disposed at least partially on a third surface of the dielectric substrate, the third surface substantially opposing the first surface, and at least partially on the second surface, the second antenna element configured to be coupled to the ground plane at a second location, and an electromagnetic coupling element disposed substantially between at least portions of the first element and the second element. The ground plane is arranged a first predetermined distance away from the dielectric substrate along at least a portion of a fourth surface of the dielectric substrate, and a feed structure is galvanically coupled to the first antenna element at a third location, and is coupled to the second antenna element through the electromagnetic coupling element so as to form a resonant structure between the first antenna element, the second antenna element, the dielectric substrate, and the ground plane.

In a second aspect of the invention, a chip component is disclosed. In one embodiment, the chip component comprises: a dielectric substrate comprising a plurality of surfaces, a first antenna element disposed at least partially on a first, a second and a third surface of the substrate, the first antenna element adapted to couple to a ground plane at a first location, a second antenna element disposed at least partially on the first surface of the substrate, and at least partially on the third surface of the substrate, the second antenna element adapted to couple to the ground plane at a second location, and an electromagnetic coupling element disposed substantially between the first antenna element and the second antenna element. The coupling element is configured to electromagnetically couple the second antenna element to the first antenna element. The first antenna element is configured to be galvanically coupled to a feed structure at a third location, the galvanic coupling comprising a conductive material asymmetrically coupled to the third surface to provide a substantially omni-directional radiation pattern within at least a first frequency range.

In one variant, the second antenna element is disposed at least partially on the second surface, and is further configured to be coupled to the ground plane at a fourth location, and the first antenna element is disposed at least partially on the fourth surface of the dielectric substrate, and the second antenna element is disposed at least partially on a fifth surface of the dielectric substrate, the fifth surface substantially opposing the fourth surface.

In another variant, the second and the fourth surface share a common first edge, the third and the fourth surface share a common second edge, the third and the fifth surface share a common third edge, the second and the fifth surface share a common fourth edge, the first antenna element is disposed over a first area proximate the first edge and the second edge, and the second antenna element is disposed over a third area proximate the third edge and the fourth edge, such that the first location is proximate the first edge, the second location is proximate the third edge, the third location is proximate the second edge, and the fourth location is proximate the fourth edge.

In another variant, the electromagnetic coupling element comprises a substantially linear slot positioned on the second surface.

In still another variant, the electromagnetic coupling element comprises a slot comprised of at least one turn that forms at least one finger-like projection extending between respective open ends of the first antenna element and the second antenna element.

In yet another variant, the first antenna element is disposed at least partially on a fourth surface of the dielectric substrate, and the second antenna element is disposed at least partially on a fifth surface of the dielectric substrate, the fifth surface substantially opposing the fourth surface such that the second and the fourth surface share a common first edge, the second and the fifth surface share a common second edge, the first antenna element is disposed over an area proximate the first edge, and the second antenna element is disposed over an area proximate the second edge.

In another embodiment, the chip component comprises a first layer, comprising a ground plane, a second layer, having a first end and a second end, disposed substantially parallel to the first layer, and comprising a conductive element, the conductive element.

In one variant, the conductive element comprises: a first antenna element coupled to the ground plane at a first location proximate the first end, a second antenna element coupled to the ground plane at a second location proximate the second end, and an electromagnetic coupling element disposed between the first antenna element and the second antenna element, a dielectric substrate, disposed substantially between the first and the second layer, a first and a second interconnect structure configured to couple the first layer to the first and second ends of the second layer, respectively, and a feed structure coupled to the first antenna element at a third location and coupled to the second antenna element through the electromagnetic coupling element so as to form a resonant structure between the first antenna element, the second antenna element, the dielectric substrate, and the ground plane. The first antenna element is disposed at least partially on the first interconnect structure, and the second antenna element is disposed at least partially on the second interconnect structure.

In another embodiment, the chip component is produced by the method comprising using of a semiconductor technique; i.e., by growing a metal layer on the surface of the substrate (e.g. quartz substrate), and removing a part of it so that the elements remain.

BRIEF DESCRIPTION OF THE DRAWINGS

In the following, the invention will be described in more detail. Reference will be made to the accompanying drawings, wherein.

DETAILED DESCRIPTION OF THE INVENTION

Reference is now made to the drawings wherein like numerals refer to like parts throughout.

As used herein, the terms "wireless", "radio" and "radio frequency" refer without limitation to any wireless signal, data, communication, or other interface or radiating component including without limitation Wi-Fi, Bluetooth, 3G (3GPP/3GPPS), HSDPA/HSUPA, TDMA, CDMA (e.g., IS-95A, WCDMA, etc.), FHSS, DSSS, GSM, UMTS, PAN/802.15, WiMAX (802.16), 802.20, narrowband/FDMA, OFDM, PCS/DCS, analog cellular, CDPD, satellite systems, millimeter wave, or microwave systems.

Additionally, as used herein, the term "chip antenna" means without limitation an antenna structure comprising a chip component. In addition to the actual chip component itself, the structure may comprise the ground arrangement surrounding it and the antenna feed arrangement.

Figure 2:
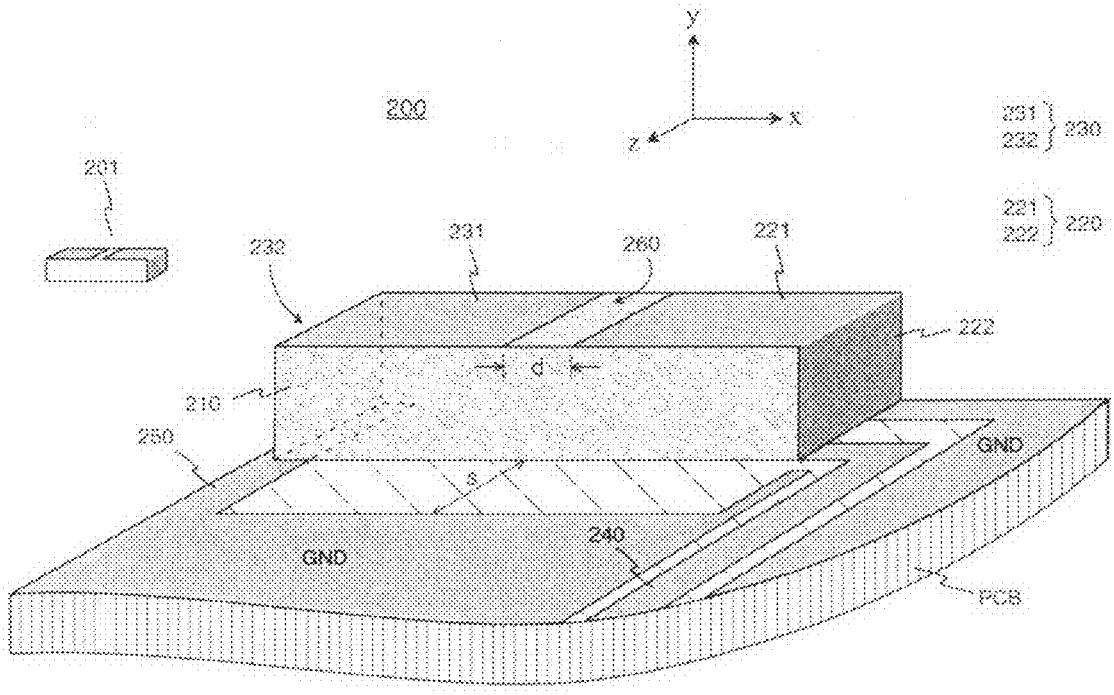
FIG. 2 presents an example of a chip antenna according to the invention.
Figure 4A:
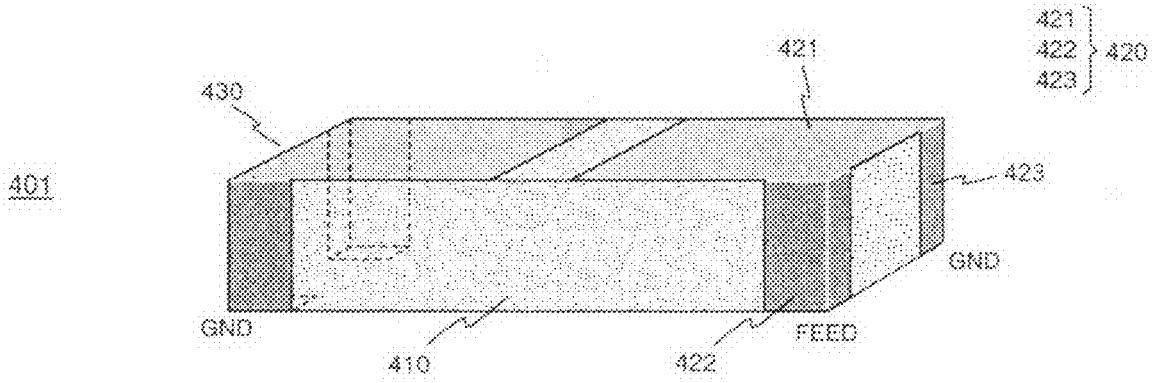
FIGS. 4*a* and 4*b* present another example of the chip component of an antenna according to the invention.

It will further be appreciated that as used herein, the qualifiers "upper" and "lower" refer to the relative position of the antenna shown in FIGS. 2 and 4*a*, and have nothing to do with the position in which the devices are used, and in no way are limiting, but rather merely for convenient reference.

Overview

In one salient aspect, the present invention comprises a chip component (and antenna formed therefrom) which overcomes the aforementioned deficiencies of the prior art.

Specifically, one embodiment of the invention comprises a plurality (e.g., two) radiating antenna elements on the surface of a dielectric substrate chip. Each of them is substantially symmetric and of a similar or same size, and covers one of the opposing heads, and part of the upper surface of the (e.g., rectangular) chip. In the middle of the upper surface between the elements is formed a slot. The circuit board or other substrate, on which the chip component is mounted, has no ground plane under the chip nor on its sides up to a certain distance. The lower edge of one of the radiating elements is galvanically connected to the antenna feed conductor on the circuit board, and at another point to the ground plane, while the lower edge of the opposite radiating element, or the parasitic element, is galvanically connected only to the ground plane. The parasitic element obtains its feed through said electromagnetic coupling, and both elements resonate with substantially equal strength at the operating frequency.

In one embodiment, the aforementioned component is manufactured by a semiconductor technique; e.g., by growing a metal layer on the surface of quartz or other type of substrate, and removing a part of it so that the elements remain.

In addition, the invention has the advantage that the efficiency of an antenna made using such a component is high, in spite of the use of the dielectric substrate. This is due to the comparatively simple structure of the antenna, which produces an uncomplicated current distribution in the antenna elements, and correspondingly a simple field image in the substrate without "superfluous" waveforms.

Moreover, the invention has an excellent omnidirectional radiation profile, which is largely due to the symmetrical structure, shaping of the ground plane, and the nature of the coupling between the elements.

A still further advantage of the invention is that both the tuning and the matching of an antenna can be carried out without discrete components; i.e., just by changing the width of the slot, shaping the conductor pattern of the circuit board near the antenna component, etc.

Yet another advantage of the invention is that the antenna according to it is very small and simple and tolerates relatively high field strengths.

DESCRIPTION OF THE EXEMPLARY EMBODIMENTS

Detailed discussions of various exemplary embodiments of the invention are now provided. It will be recognized that while described in terms of particular applications (e.g., mobile devices including for example cellular telephones), materials, components, and operating parameters (e.g., frequency bands), the various aspects of the invention may be practiced with respect to literally any wireless or radio frequency application.

Figure 1:
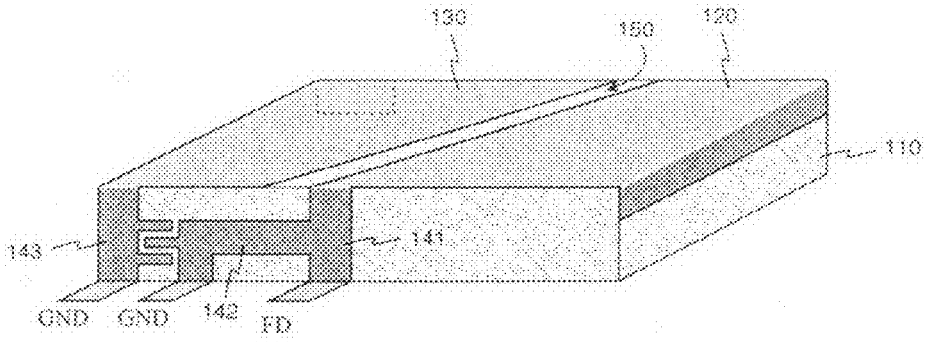
Fig. 1 PRIOR ART
FIG. 1 presents an example of a prior art chip antenna.

FIG. 2 shows an example of a chip antenna according to one embodiment of the invention. The antenna 200 comprises a dielectric substrate chip and a plurality (two in this embodiment) radiating elements on its surface, one of which has been connected to the feed conductor of the antenna and the other which is an electromagnetically fed parasitic element, somewhat akin to the prior art antenna of FIG. 1. However, there are several structural and functional differences between those antennas. In the antenna according to the invention, among other things; the slot separating the radiating elements is between the open ends of the elements and not between the lateral edges.

Moreover, the parasitic element obtains its feed through the coupling prevailing over the slot and not through the coupling between the ground conductor of the parasitic element and the feed conductor. The first radiating element 220 of the antenna 200 comprises a portion 221 partly covering the upper surface of an elongated, rectangular substrate 210 and a head portion 222 covering one head of the substrate. The second radiating element comprises a portion 231 symmetrically covering the upper surface of the substrate partly and a head portion 232 covering the opposite head. Each head portion 222 and 232 continues slightly on the side of the lower surface of the substrate, thus forming the contact surface of the element for its connection. In the middle of the upper surface between the elements there remains a slot 260, over which the elements have an electromagnetic coupling with each other. The slot 260 extends in this example in the transverse direction of the substrate perpendicularly from one lateral surface of the substrate to the other, although this is by no means a requirement for practicing the invention.

The chip component 201, or the substrate with its radiators, is in FIG. 2 on the circuit board (PCB) on its edge and its lower surface against the circuit board. The antenna feed conductor 240 is a strip conductor on the upper surface of the circuit board, and together with the ground plane, or the signal ground GND, and the circuit board material, it forms a feed line having a certain impedance. The feed conductor 240 is galvanically coupled to the first radiating element 220 at a certain point of its contact surface. At another point of the contact surface, the first radiating element is galvanically coupled to the ground plane GND. At the opposite end of the substrate, the second radiating element 230 is galvanically coupled at its contact surface to the ground conductor 250, which is an extension of the wider ground plane GND. The width and length of the ground conductor 250 have a direct effect on the electric length of the second element and thereby on the natural frequency of the whole antenna. For this reason, the ground conductor can be used as a tuning element for the antenna.

The tuning of the antenna is also influenced by the shaping of the other parts of the ground plane, too, and the width d of the slot 260 between the radiating elements. There is no ground plane under the chip component 201, and on the side of the chip component the ground plane is at a certain distance s from it. The longer the distance, the lower the natural frequency. In turn, increasing the width d of the slot increases the natural frequency of the antenna. The distance s also has an effect on its impedance. Therefore the antenna can advantageously be matched by finding the optimum distance of the ground plane from the long side of the chip component. In addition, removing the ground plane from the side of the chip component improves the radiation characteristics of the antenna, such as its omnidirectional radiation.

At the operating frequency, both radiating elements together with the substrate, each other and the ground plane form a quarter-wave resonator. Due to the above described structure, the open ends of the resonators are facing each other, separated by the slot 260, and said electromagnetic coupling is clearly capacitive. The width d of the slot can be dimensioned so that the resonances of both radiators are strong and that the dielectric losses of the substrate are minimized. The optimum width is, for example, 1.2 mm and a suitable range of variation 0.8-2.0 mm, for example. When a ceramic substrate is used, the structure provides a very small size. The dimensions of a chip component of an exemplary Bluetooth antenna operating on the frequency range 2.4 GHz are $2\times2\times7$ mm$^3$, for example, and those of a chip component of a GPS (Global Positioning System) antenna operating at the frequency of 1575 MHz $2\times3\times10$ mm$^3$, for example.

Figure 3:
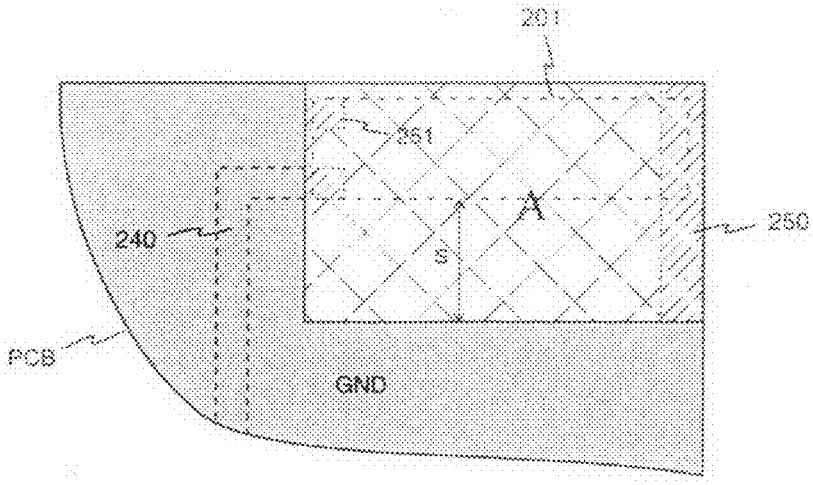
FIG. 3 shows a part of a circuit board belonging to the antenna structure of FIG. 2 from the reverse side.

FIG. 3 shows a part of the circuit board belonging to the antenna structure of FIG. 2 as seen from below. The chip component 201 on the other side of the circuit board (PCB) has been marked with dashed lines in the drawing. Similarly with dashed lines are marked the feed conductor 240, the ground conductor 250 and a ground strip 251 extending under the chip component to its contact surface at the end on the side of the feed conductor. A large part of the lower surface of the circuit board belongs to the ground plane GND. The ground plane is missing from a corner of the board in the area A, which comprises the place of the chip component and an area extending to a certain distance s from the chip component, having a width which is the same as the length of the chip component.

FIG. 4*a* shows another example of the chip component of an antenna according to the invention. The component 401 is mainly similar to the component 201 presented in FIG. 2. The difference is that now the radiating elements extend to the lateral surfaces of the substrate 410 at the ends of the component, and the heads-of-the substrate are largely uncoated. Thus the first radiating element 420 comprises a portion 421 partly covering the upper surface of the substrate, a portion 422 in a corner of the substrate and a portion 423 in another corner of the same end. The portions 422 and 423 in the corners are partly on the side of the lateral surface of the substrate and partly on the side of the head surface. They continue slightly to the lower surface of the substrate, forming thus the contact surface of the element for its connection. The second radiating element 430 is similar to the first one and is located symmetrically with respect to it. The portions of the radiating elements being located in the corners can naturally also be limited only to the lateral surfaces of the substrate or only to one of the lateral surfaces. In the latter case, the conductor coating running along the lateral surface continues at either end of the component under it for the whole length of the end.

Figure 4B:
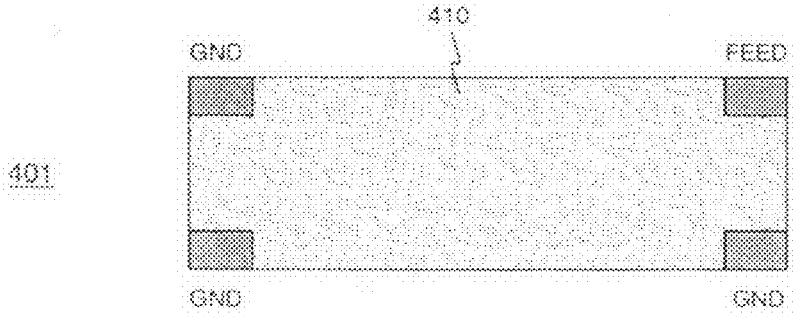

In FIG. 4*b*, the chip component 401 of FIG. 4*a* is seen from below. The lower surface of the substrate 410 and the conductor pads serving as said contact surfaces in its corners are seen in the figure. One of the conductor pads at the first end of the substrate is intended to be connected to the antenna feed conductor and the other one to the ground plane GND. Both of the conductor pads at the second end of the substrate are intended to be connected to the ground plane.

Figure 5:
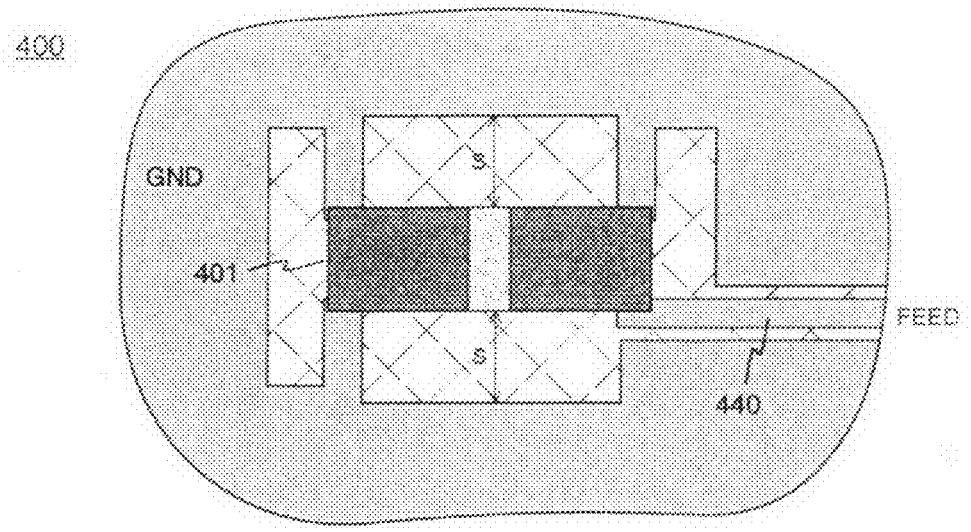
FIG. 5 presents a whole antenna with a chip component according to FIG. 4*a;*

FIG. 5 shows a chip component according to FIGS. 4*a* and 4*b* as mounted on the circuit board so that a whole antenna 400 is formed. Only a small part of the circuit board is visible is this embodiment. Now the chip component 401 is not located at the edge of the circuit board, and therefore there is a groundless area on its both sides up to a certain distance s. The antenna feed conductor 440 is connected to the chip component in one corner of its lower surface, and the ground plane extends to other corners corresponding FIG. 4*b*.

Figure 6A:
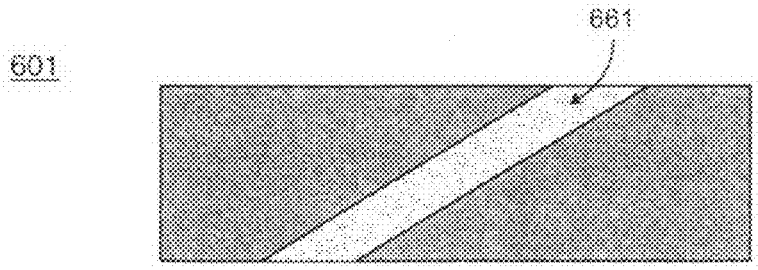
FIGS. 6*a-d* show examples of shaping of the slot between the radiating elements in an antenna according to the invention.

FIGS. 6*a-d* show examples of shaping of the slot between the radiating elements in an antenna according to the invention. In FIG. 6*a*, the antenna's chip component 601 is seen from above and in FIG. 6*b* the chip component 602 is seen from above. Both the slot 661 in component 601 and the slot 662 in component 602 travel diagonally across the upper surface of the component from the first to the second side of the component. The slot 662 is yet more diagonal and thus longer than the slot 661, extending from a corner to the opposite, farthest corner of the upper surface of the chip component. In addition, the slot 662 is narrower than the slot 661. It is mentioned before that broadening the slot increases the natural frequency of the antenna. Vice versa, narrowing the slot decreases the natural frequency of the antenna, or shifts the antenna operation band downwards. Lengthening the slot by making it diagonal affects in the same way, even more effectively.

Figure 6B:
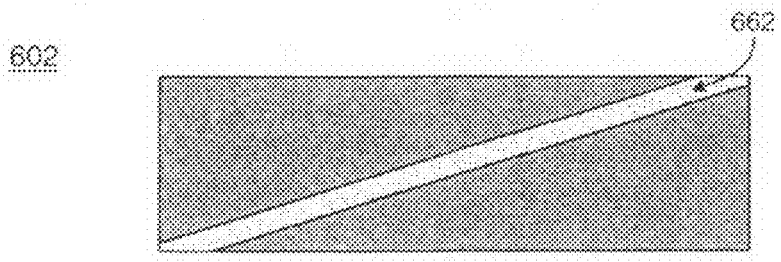
Figure 6C:
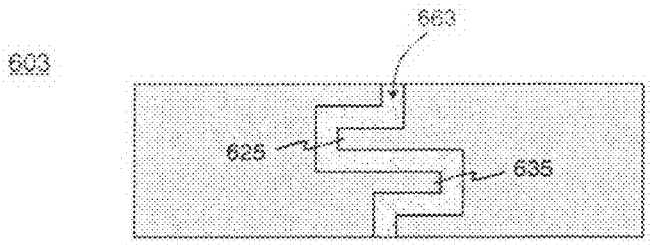
Figure 6D:
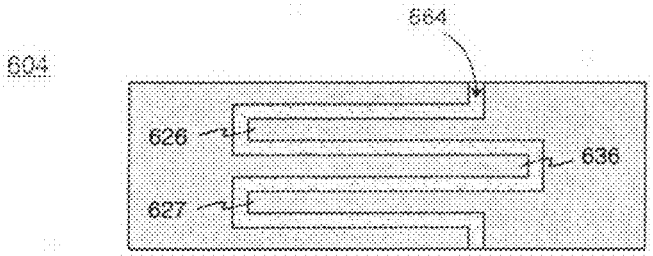

In FIG. 6*c* the antenna's chip component 603 is seen from above, and in FIG. 6*d* the chip component 604 is seen from above. Both the slot 663 in component 603 and the slot 664 in component 604 now have turns. The slot 663 has six rectangular turns so that a finger-like strip 625 is formed in the first radiating element, the strip extending between the regions, which belong to the second radiating element. Symmetrically, a finger-like strip 635 is formed in the second radiating element, this strip extending between the regions, which belong to the first radiating element. The number of the turns in the slot 664 belonging to the component 604 is greater so that two finger-like strips 626 and 627 are formed in the first radiating element, these strips extending between the regions, which belong to the second radiating element. Between these strips there is a finger-like strip 636 as a projection of the second radiating element. The strips in the component 604 are, besides more numerous, also longer than the strips in the component 603, and in addition the slot 664 is narrower than the slot 663. For these reasons the operation band of an antenna corresponding to the component 604 is located lower down than the operation band of an antenna corresponding to the component 603.

Figure 7:
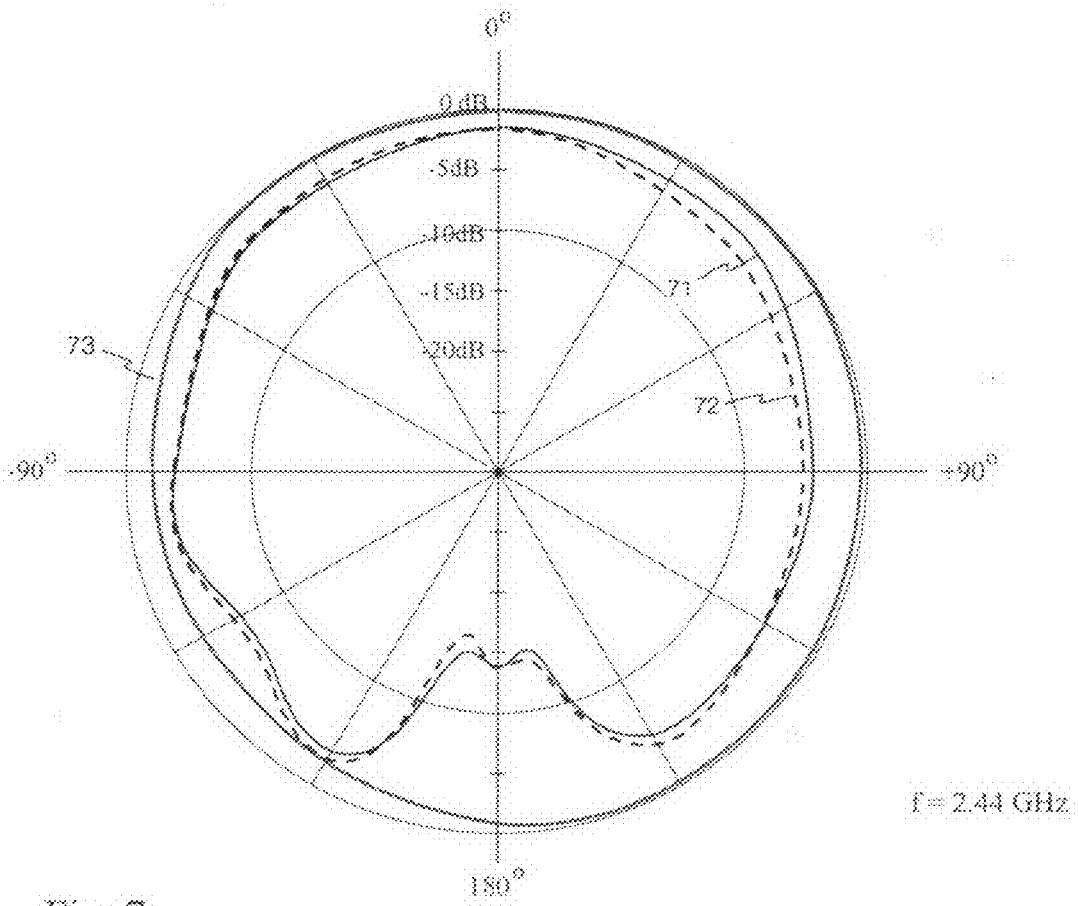
FIG. 7 shows an example of the directional characteristics of an antenna according to the invention, placed in a mobile phone.

FIG. 7 presents an example of the directional characteristics of an antenna according to the invention, being located in a mobile phone. The antenna has been dimensioned for the Bluetooth system. There are three directional patterns in the Figure: (i) the directional pattern 71 presents the antenna gain on plane XZ; (ii) the directional pattern 72 on plane YZ; and (iii) the directional pattern 73 on plane XY; wherein the X axis is the longitudinal direction of the chip component, the Y axis is the vertical direction of the chip component and the Z axis is the transverse direction of the chip component. It is seen from the patterns that the antenna transmits and receives well on all planes and in all directions. On the plane XY in particular, the pattern is substantially even. The two others only have a recess of 10 dB in a sector about 45 degrees wide. The totally "dark" sectors typical in directional patterns do not exist at all.

Figure 8:
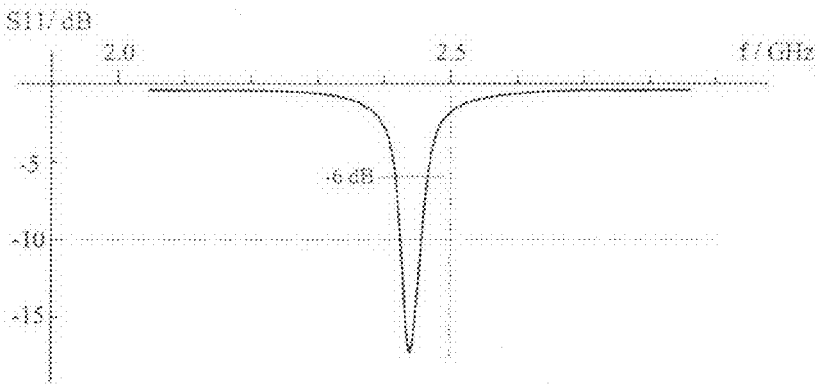
FIG. 8 shows an example of band characteristics of an antenna according to the invention.

FIG. 8 presents an example of the band characteristics of an antenna according to one embodiment of the invention. It presents a curve of the reflection coefficient S11 as a function of frequency. The curve has been measured from the same Bluetooth antenna the patterns of FIG. 6. If the criterion for the cut-off frequency is the value −6 dB of the reflection coefficient, the bandwidth becomes about 50 MHz, which is about 2% as a value. In the center of the operating band, at the frequency of 2440 MHz, the reflection coefficient is −17 dB, which indicates good matching. The Smith diagram shows that in the center of the band, the impedance of the antenna is purely resistive, below the center frequency slightly inductive, and above the centre frequency slightly capacitive, respectively.

Figure 9:
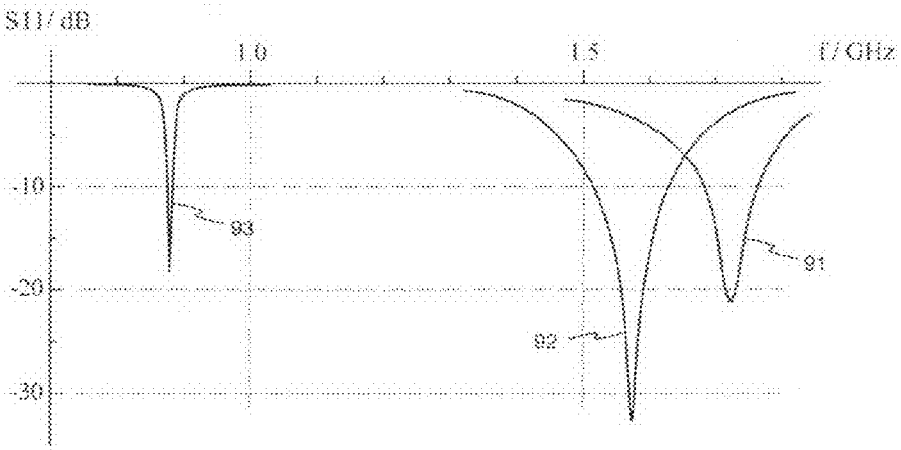
FIG. 9 shows an example of an effect of the shape of the slot between the radiating elements on the place of the antenna operation band.

FIG. 9 presents an example of an effect of the shape of the slot between the radiating elements on the place of the antenna operation band.

The curve 91 shows the fluctuation of the reflection coefficient S11 as a function of frequency in the antenna, the size of the chip component of which is $10\times3\times4$ mm$^3$, and the slot between the radiating elements is perpendicular. The resonance frequency of the antenna, which is approximately the same as the medium frequency of the operation band, falls on the point 1725 MHz.

The curve 92 shows the fluctuation of the reflection coefficient, when the slot between the radiating elements is diagonal according to FIG. 6*b*. In other respects the antenna is similar as in the previous case. Now the resonance frequency of the antenna falls on the point 1575 MHz, the operation band thus being located about 150 MHz lower than in the previous case. The frequency 1575 MHz is used by the GPS (Global Positioning System). A frequency lower than that can in practice be reached in the antenna in question by using a diagonal slot.

The curve 93 shows the fluctuation of the reflection coefficient, when the slot between the radiating elements has turns according to FIG. 6*d* and is somewhat narrower than in the two previous cases. In other respects the antenna is generally similar. Now the operation band of the antenna is lower nearly by a half compared to the case corresponding to the curve 91. The resonance frequency falls on the point 880 MHz, which is located in the range used by the EGSM system (Extended GSM).

A ceramics having the value 20 of the relative dielectric coefficient $\in_r$ is used for the antenna in the three cases of FIG. 9. Using a ceramics with a higher $\in_r$ value, also the band of an antenna equipped with a diagonal slot can be placed for example in the range of 900 MHz without making the antenna bigger. However, the electric characteristics of the antenna may then be somewhat reduced.

Figure 10:
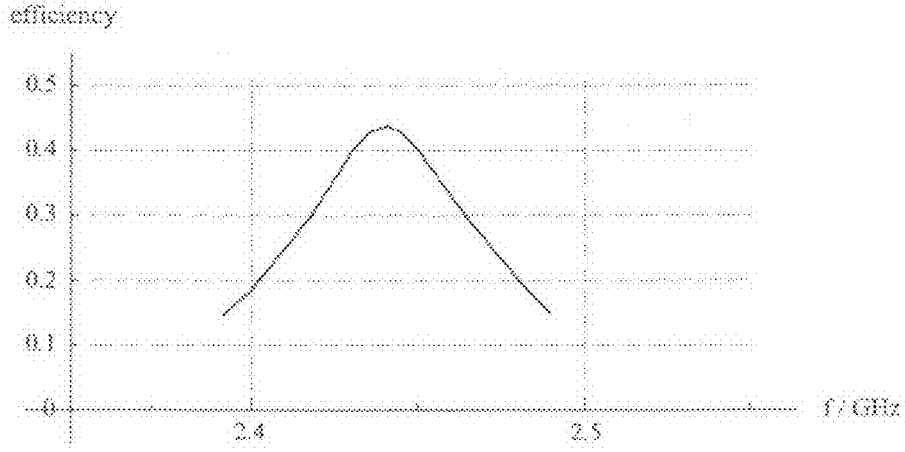
FIG. 10 shows an example of the efficiency of an antenna according to the invention.

FIG. 10 shows an example of the efficiency of an antenna according to the invention. The efficiency has been measured from the same Bluetooth antenna as the patterns of FIGS. 7 and 8. At the centre of the operating band of the antenna the efficiency is about 0.44, and decreases from that to the value of about 0.3 when moving 25 MHz to the side from the centre of the band. The efficiency is considerably high for an antenna using a dielectric substrate.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. Antenna apparatus, comprising:

a dielectric substrate comprising a plurality of surfaces;

a ground plane;

a first antenna element disposed at least partially on a first surface of the dielectric substrate and at least partially on a second surface of the dielectric substrate, the first antenna element configured to be coupled to the ground plane at a first location;

a second antenna element disposed at least partially on a third surface of the dielectric substrate, the third surface and the first surface being disposed substantially at opposite ends of the substrate, and at least partially on the second surface, the second antenna element configured to be coupled to the ground plane at a second location; and an electromagnetic coupling element disposed substantially between the first element and the second element;

wherein the first antenna element is configured to be galvanically coupled to a feed structure at a third location; and wherein the second antenna element is configured to be electromagnetically coupled to the feed structure through the electromagnetic coupling element so as to form a resonant structure between the first antenna element, the second antenna element, the dielectric substrate, and the ground plane.

2. The antenna apparatus of claim 1, wherein the ground plane is disposed a first predetermined distance away from the dielectric substrate along at least a portion of a fourth surface and along at least a portion of a fifth surface of the dielectric substrate, said fifth surface substantially opposing said fourth surface.

3. The antenna apparatus of claim 2, wherein the ground plane is further disposed: (i) a second predetermined distance away from the dielectric substrate along at least a portion of the first surface; and (ii) a third predetermined distance away from the dielectric substrate along at least a portion of the third surface.

4. The antenna apparatus of claim 2, wherein the first and the third locations are disposed proximate a first and a second corner of the dielectric substrate, respectively, said first and said second corner arranged along a first edge of the dielectric substrate.

5. The antenna apparatus of claim 4, wherein the second location is disposed proximate a third corner of the dielectric substrate, said third corner arranged along a second edge of the dielectric substrate, said second edge substantially opposing said first edge.

6. The antenna apparatus of claim 1, wherein the second antenna element is further configured to be coupled to the ground plane at a fourth location, said fourth location positioned distally relative to the electromagnetic coupling element.

7. The antenna apparatus of claim 6, wherein:

the first and the third locations are disposed proximate a first and a second corner of the dielectric substrate, respectively;

the second and the fourth locations are disposed proximate a third and a fourth corner of the dielectric substrate, respectively;

said first and said second corner arranged along a first edge of the dielectric substrate; and said third and said fourth corner are arranged along a second edge of the dielectric substrate, said second edge opposing said first edge.

8. A chip component, comprising:

a dielectric substrate comprising a plurality of surfaces;

a first antenna element disposed at least partially on a first, a second and a third surface of said substrate, the first antenna element adapted to couple to a ground plane at a first location;

a second antenna element disposed at least partially on the first surface of said substrate, and at least partially on the third surface of said substrate, the second antenna element adapted to couple to the ground plane at a second location; and an electromagnetic coupling element disposed substantially between the first antenna element and the second antenna element and configured to electromagnetically couple the second antenna element to the first antenna element;

wherein the first antenna element is configured to be galvanically coupled to a feed structure at a third location, said galvanic coupling comprising a conductive material asymmetrically coupled to the third surface to provide a substantially omni-directional radiation pattern within at least a first frequency range.

9. The chip component of claim 8, wherein the second antenna element is disposed at least partially on the second surface, and is further configured to be coupled to the ground plane at a fourth location.

10. The chip component of claim 9, wherein:

the first antenna element is disposed at least partially on the fourth surface of the dielectric substrate; and the second antenna element is disposed at least partially on a fifth surface of the dielectric substrate, the fifth surface substantially opposing the fourth surface.

11. The chip component of claim 10, wherein:

the second and the fourth surface share a common first edge;

the third and the fourth surface share a common second edge;

the third and the fifth surface share a common third edge;

the second and the fifth surface share a common fourth edge;

the first antenna element is disposed over a first area proximate said first edge and said second edge; and the second antenna element is disposed over a third area proximate said third edge and said fourth edge.

12. The chip component of claim 11, wherein:

the first location is proximate the first edge;

the second location is proximate the third edge;

the third location is proximate the second edge; and the fourth location is proximate the fourth edge.

13. The chip component of claim 8, wherein the electromagnetic coupling element comprises a substantially linear slot positioned on the second surface.

14. The chip component of claim 8, wherein the electromagnetic coupling element comprises a slot comprised of at least one turn.

15. The chip component of claim 14, wherein the at least one turn forms at least one finger-like projection extending between respective open ends of the first antenna element and the second antenna element.

16. The chip component of claim 8, wherein:

the first antenna element is disposed at least partially on a fourth surface of the dielectric substrate; and the second antenna element is disposed at least partially on a fifth surface of the dielectric substrate, the fifth surface substantially opposing the fourth surface.

17. The chip component of claim 16, wherein:

the second and the fourth surface share a common first edge;

the second and the fifth surface share a common second edge;

the first antenna element is disposed over an area proximate said first edge; and the second antenna element is disposed over an area proximate said second edge.

18. An antenna apparatus, comprising:

a dielectric substrate comprising a plurality of surfaces;

a ground plane;

a first antenna element disposed at least partially on a first surface of the dielectric substrate and at least partially on a second surface of the dielectric substrate, the first antenna element configured to be coupled to the ground plane at a first location;

a second antenna element disposed at least partially on a third surface of the dielectric substrate, the third surface substantially opposing the first surface, and at least partially on the second surface, the second antenna element configured to be coupled to the ground plane at a second location; and an electromagnetic coupling element disposed substantially between at least portions of the first element and the second element;

wherein the ground plane is arranged a first predetermined distance away from the dielectric substrate along at least a portion of a fourth surface of the dielectric substrate; and wherein a feed structure is galvanically coupled to the first antenna element at a third location, and is coupled to the second antenna element through the electromagnetic coupling element so as to form a resonant structure between the first antenna element, the second antenna element, the dielectric substrate, and the ground plane.

19. The antenna apparatus of claim 18, wherein the ground plane is further disposed the first predetermined distance away from the dielectric substrate along at least a portion of a fifth surface, said fifth surface arranged substantially opposing said fourth surface.

20. The antenna apparatus of claim 19, wherein the ground plane is further disposed a second predetermined distance away from the dielectric substrate along at least a portion of the first surface and along at least a portion of the third surface of the dielectric substrate.

21. The antenna apparatus of claim 18, wherein the electromagnetic coupling element comprises an open slot configured substantially between open ends of the first and the second antenna elements.

22. The antenna apparatus of claim 21, wherein the first and the second locations are positioned distally relative to the electromagnetic coupling element.

23. The antenna apparatus of claim 18, wherein the first and the third location are disposed proximate to an edge of the first surface, and the second location is disposed proximate to an edge of the third surface.

24. The antenna apparatus of claim 18, wherein:

the ground plane is coupled to the first surface at the first location and to the third surface at the second location; and the first and the second locations are positioned distally relative to the electromagnetic coupling element.

25. The antenna apparatus of claim 18, wherein at least one of the first or the second antenna elements is formed at least partially on a fourth surface of the dielectric substrate.

26. The antenna apparatus of claim 25, wherein at least one of the first and/or the second antenna elements is formed at least partially on a fifth surface of the dielectric substrate; the fifth surface substantially opposing the fourth surface.

27. The antenna apparatus of claim 18, wherein at least one of the first or second antenna elements is formed at least partially on a sixth surface of the dielectric substrate.

28. The antenna apparatus of claim 18, wherein the second antenna element is further configured to be coupled to the ground plane at a fourth location, said second, said first, and said fourth location positioned distally relative to the electromagnetic coupling element.

29. A chip component, comprising:

a first layer comprising a ground plane;

a second layer having a first end and a second end, the second layer being disposed substantially parallel to the first layer and comprising a conductive element, the conductive element comprising:

a first antenna element coupled to the ground plane at a first location proximate the first end;

a second antenna element coupled to the ground plane at a second location proximate the second end; and an electromagnetic coupling element disposed between the first antenna element and the second antenna element;

a dielectric substrate, disposed substantially between the first and the second layer;

a first and a second interconnect structure configured to couple the first layer to the first and second ends of the second layer, respectively; and a feed structure coupled to the first antenna element at a third location and coupled to the second antenna element through the electromagnetic coupling element so as to form a resonant structure between the first antenna element, the second antenna element, the dielectric substrate, and the ground plane;

wherein the first antenna element is disposed at least partially on the first interconnect structure, and the second antenna element is disposed at least partially on the second interconnect structure.

* * * * *

UNITED STATES PATENT AND TRADEMARK OFFICE

CERTIFICATE OF CORRECTION

PATENT NO. : 7,973,720 B2
APPLICATION NO. : 12/661394
DATED : July 5, 2011
INVENTOR(S) : Juha Sorvala It is certified that error appears in the above-identified patent and that said Letters Patent is hereby corrected as shown below:

Title page, item 56

CURRENTLY READS:
Page 2, Foreign Patent Documents, 18th Citation
EP 1 151 334 8/2003

SHOULD READ:
Page 2, Foreign Patent Documents, 18th Citation
-- EP 1 351 334 8/2003 --

Signed and Sealed this
Fourth Day of October, 2011

David J. Kappos

David J. Kappos
*Director of the United States Patent and Trademark Office*